US006135205A

United States Patent [19]

Phillips

[11] Patent Number: 6,135,205

[45] Date of Patent: Oct. 24, 2000

[54] APPARATUS FOR AND METHOD OF HYDRAULIC FRACTURING UTILIZING CONTROLLED AZUMITH PERFORATING

[75] Inventor: Arnold D. Phillips, Tyler, Tex.

[73] Assignee: Halliburton Energy Services, Inc., Houston, Tex.

[21] Appl. No.: 09/070,417

[22] Filed: Apr. 30, 1998

[51] Int. Cl.[7] ..... E21B 43/119; E21B 43/26

[52] U.S. Cl. ..... 166/297; 166/308

[58] Field of Search ..... 166/250.1, 254.1, 166/297, 308

[56] References Cited

U.S. PATENT DOCUMENTS

| | | | |
|---|---|---|---|
| 4,199,034 | 4/1980 | Salisbury et al. | 166/308 X |
| 4,635,719 | 1/1987 | Zoback et al. | 166/250 |
| 4,662,440 | 5/1987 | Harmon et al. | 166/245 |
| 4,714,115 | 12/1987 | Uhri | 166/308 |
| 4,779,680 | 10/1988 | Sydansk | 166/300 |
| 4,858,689 | 8/1989 | Logan | 166/256 |
| 4,977,961 | 12/1990 | Avasthi | 166/297 |
| 5,074,359 | 12/1991 | Schmidt | 166/280 |
| 5,372,195 | 12/1994 | Swanson et al. | 166/308 |
| 5,472,049 | 12/1995 | Chaffee et al. | 166/250.1 |
| 5,482,116 | 1/1996 | El-Rabaa et al. | 166/250.1 |
| 5,499,678 | 3/1996 | Surjaatmadja et al. | 166/308 X |
| 5,513,703 | 5/1996 | Mills et al. | 166/55.1 |
| 5,564,499 | 10/1996 | Willis et al. | 166/299 |
| 5,934,373 | 8/1999 | Warpinski et al. | 166/250.1 |

*Primary Examiner*—George Suchfield
*Attorney, Agent, or Firm*—J. M. Gilbreth; Gilbreth & Associates, P.C.

[57] ABSTRACT

A method of perforating a subterranean formation penetrated by a bore hole and having a multiplicity of strata including a hydrocarbon bearing target strata, with the strata oriented with the dip of the strata running in a first direction. The method generally includes positioning a perforation gun in the well bore adjacent to the hydrocarbon bearing target strata. Next includes orienting the perforating guns so that it will perforate the target strata in a direction perpendicular to the first direction. The method finally includes perforating the target strata. A method of hydraulically fracturing the above described subterranean formation would further include pumping a fluid under pressure into the so formed perforations.

10 Claims, 2 Drawing Sheets

APPARATUS FOR AND METHOD OF HYDRAULIC FRACTURING UTILIZING CONTROLLED AZUMITH PERFORATING

BACKGROUND OF THE INVENTION

1. Field of the Invention

The present invention relates to an apparatus for and methods of producing hydrocarbons from subterranean formations. In another aspect, the present invention relates to apparatus for and methods of producing hydrocarbons from subterranean formations utilizing hydraulic fracturing. In even another aspect, the present invention relates to apparatus for and methods of producing hydrocarbons from subterranean formations by hydraulic fracturing utilizing controlled azumith perforating.

In the production of hydrocarbons from subterranean formations, it has been a long standing practice to hydraulically fracture the formation from a well bore to enhance the flow of hydrocarbons from the formation into the well bore.

2. Description of the Related Art

In the completion of wells drilled into the earth, a string of casing is normally run into the well and a cement slurry is flowed into the annulus between the casing string and the wall of the well. The cement slurry is allowed to set and form a cement sleeve which bonds the string casing to the wall of the well. Perforations are provided through the casing and cement plane adjacent to subsurface formation. Fluids, such as oil or gas, are produced through these perforations into the well.

However, the productivity or injectivity of a well bore and fluid communication with the subterranean hydrocarbon bearing formation may be undesirably low due to a number of causes, including low permeability of the formation rock, placement of casing cement, plugging by previously injected materials, clay damage, or produced fluid damage.

Fracturing treatments are usually performed soon after the formation interval to be produced is completed, that is, soon after fluid communication between the wall and the reservoir interval established. Wells are also sometimes fractured for the purpose of stimulating production after significant depletion of the reservoir. Hydraulic fracturing generally entails injecting a fluid into the well bore at a sufficient rate and pressure to overcome the tensile strength of the formation and the over burden pressure. The injected fluid creates cracks or fractures extending from the well bore out into the formation which are usually propped open with a solid proppant entrained in the fluid. The fractures permit the flow of hydrocarbons and other fluids into or out of the well bore.

In recent years, hydraulic fracturing applications from bore holes and geological formations have expanded dramatically to meet the needs of such emerging technologies as in situ, horizontal completion of oil gas wells, methane gas mining, and non-explosive rock demolition. Years ago, hydraulic fracturing was characterized by a generation of randomly oriented fractures and mere propping or extending of existing cracks or partings. Increasingly, success of a hydraulic fracturing job is dependent upon control of hydraulic fracture origin and orientation. In some applications, hydraulic fractures must originate at a specific location along the length of a bore hole. In other applications, hydraulic fractures must run with a specified orientation to the local geological structure, the bore hole from which they originate, or some other structure.

It has been recognized from some time that the propagation of a fracture in an earth formation proceeds generally in a plane which is normal to the direction of the minimum principal stress existing in the formation. In a majority of cases, in deep well bores, the direction of this stress is horizontal and, accordingly, the fracture is a generally vertical propagating fracture in a plane perpendicular to the minimum stress. In certain shallow wells, depending on formation characteristics, the fracture may propagate in a generally horizontal plane if the compressive stresses are greater in the horizontal rather than in the vertical direction.

It is desirable that the hydraulic fracture remains within the hydrocarbon bearing formation and does not extend vertically into adjacent overlying and/or underlying non-hydrocarbon bearing formations or strata. Maintaining the hydraulic fracture within the hydrocarbon bearing formation or strata results in gaining the maximum enhancement and productivity and avoiding the formation of a connection from the well bore hole to formations likely to yield water to the producing well thereby diluting or even displacing the hydrocarbons flowing into the well. When the fracture propagates, usually generally vertically, into such overlying or underlying non-producing or water bearing horizons, in the worst case, the well may become non-productive and a new well will have to be drilled. Even in less damaging circumstances, the well may be much less productive than the anticipated enhancement would call for. In situations where the overlying or underlying strata will not produce water, it is still undesirable to propagate the fracture into such strata because the expenditures for creating the fracture will have been largely wasted on non-productive formations.

The key to directional hydraulic fracturing is to restrict pressurized fluids and their egress to the desired fracturing plane so that tensile stresses are concentrated in the desired fracturing plane and the tensile strength of the geologic formation is exceeded and only the desired fracturing plane.

Applicant notes that in many commercial hydraulic fracturing operations, a perforation gun will have, spaced spirally around the gun per foot of gun, either four perforating holes spaced 90 degrees apart or six holes spaced 60 degrees apart. Such a gun will make perforations into the formation 360 degrees into the formation at either 90 or 60 degree intervals. For a reservoir that is relatively horizontal, such a perforation gunning procedure is adequate for hydraulic fracturing. However, in those instances in which the dip of the reservoir is not horizontal, perforations in a direction that is not perpendicular to the dip of the reservoir, may cut across more than one subterranean strata.

U.S. Pat. No. 4,635,719, issued Jan. 13, 1987 to Zoback, et al, discloses a method for hydraulic fracture propagation in hydrocarbon-bearing formations in which it was discovered that the least horizontal principal compressive stress, $S_3$ of a formation or strata, and therefore the required hydraulic fracture pressure, can be predicted based upon a maximum principal compressive stress, the pore fluid pressure, and the co-efficient friction of the formation.

U.S. Pat. No. 4,714,115, issued Dec. 22, 1987 to Uhri, discloses a hydraulic fracturing of a shallow subsurface formation for propagating a vertical fracture in an earth formation surrounding a borehole when the original insitu stresses favor a horizontal fracture. In this method, the case borehole is perforated at a pair of spaced apart intervals to form a pair of sets of perforations. Fracturing fluid is then initially pumped down the cased borehole and out of one of the sets of perforations to form the favored horizontal fracture. The propagation of this horizontal fracture changes the insitu stresses so as to favor the propagation of a vertical fracture. Thereafter, while maintaining pressure on the horizontal fracture, fracturing fluid is pumped down the case borehole and out of the other of the sets of perforations to form the newly favored vertical fracture.

U.S. Pat. No. 5,074,359, issued Dec. 24, 1991 to Schmidt discloses a hydraulic fracturing method for earth formations which are penetrated by included well bores when the near well bore region which exhibits the maximum tensile stress in response to hydraulic pressure in the well bore is determined, and cased well bores are perforated at the point of maximum tensile stress resulting from fracture initiation. As disclosed, the fracture is subsequently propagated and propped open by proppant-laden fluids having progressively increasing proppant concentrations so that the near well bore region of the fracture is held propped open to maintain sufficient conductivity between the main fracture body and the well bore. As another important aspect of the invention, the location of the maximum tensile stress and the formation to be seen during fracture initiation is determined using an improved method of referencing the particular point on the well bore with respect to the highest point on the well bore at which a perforation is to be provided, in a case of case well bores. Such particular point will provide for initiation of a fracture which will turn at the lowest rate into the vertical fracture plane which is perpendicular to the minimum insitu horizontal stress, thereby providing a propped region which is less likely to forcibly reclose than in fractures which are initiated in more highly stress regions of the well bore. This fracturing technique coupled with the injection of propant materials in such a way that the fracture will screen out at the outer reaches of the fracture with respect to the well bore assures that the fracture will not reclose in a region directly adjacent to the well bore.

U.S. Pat. No. 5,372,195, issued Dec. 13, 1994 to Swanson, et al, discloses a method for directional hydraulic fracturing using borehole seals to confine pressurized fluid in planar permeable regions. As disclosed, the device contains a planar region into which fluids may be pumped, and high pressure tubing, and a sealant, with the planar region located between a bore hole, a sealant and an injection tube and positioned in the plane of the intended fracture. The injection tube is in communication with both the device that forms a permeable planar region and a pump so that a pressured fluid such as pressurized water can be introduced into the permeable planar region for purposes of directional hydraulic fracturing.

U.S. Pat. No. 5,482,116, issued Jan. 9, 1996 to El-Rabaa et al, discloses a well bore guided hydraulic fracturing method which includes drilling a deviated well bore in a direction parallel to a desired fracture direction, and supplying fracturing fluid through the well bore to the formation. The invention also contemplates incrementally propagating the fracture still further beyond the downhole end of the well bore by monitoring the propagation of the fracture beyond the end of the well bore, and performing repeating fracturing steps after the fracture is at a maximum distance beyond the end of the well bore. However, the steps may also be repeated after the fracture curves to a direction parallel to the direction of the high permeability trend of the formation, whereby local insitu stresses are altered after the fractured curves.

U.S. Pat. No. 5,513,703, issued May 7, 1996 to Mills et al, discloses methods and apparatus for perforating and treating production zones and otherwise performing related activities within a well as disclosed, a plurality of perforating assemblies containing shaped charges are connected as part of casing liner which is lowered into a well bore and then anchored therein by a column of cement in the annulus between the liner and bore to locate the assemblies opposite zones in a horizontal section of the well. Work strings are lowered into selected assemblies to cause tools carried thereby to sequentially detonate the shaped charges to perforate the zone opposite hereto and to selectively open or close the perforated zones by shifting a sleeve within a housing of the assembly as well as treating the perforated zones.

U.S. Pat. No. 5,564,499, issued Oct. 15, 1996 to Willis, et al, discloses a method and device for slotting well casing and scoring surrounding rock to facilitate hydraulic fractures the method generally includes creating apertures in well casings which comprises exploding one or more linear charges in the installed well casing. In a preferred variation, the method is employed in an incline well, where it well profoundly affect the initiation of fractures during the hydraulic fracturing step.

However, in spite of these advancements in the prior art, none of these prior art references disclose or suggest methods or apparatus for suitably hydraulic fracturing a reservoir having a dip that is not horizontal.

Thus, these is still a need for improvements to the prior art methods and apparatus for hydraulic fracturing.

There is another need in the art for methods of and apparatus for hydraulically fracturing reservoirs having a dip that is not horizontal.

These and other needs in the art will become apparent to those of skill in the art upon review of this specification, including its drawings and claims.

SUMMARY OF THE INVENTION

It is an object of the present invention to provide for improved methods of and apparatus for conducting hydraulic fracturing.

It is another object of the present invention to provide for methods of and apparatus for hydraulically fracturing reservoirs having a dip which is not horizontal.

These and other objects of the present invention will become apparent to those of skill in the art upon review of this specification, including its drawings and claims.

According to one embodiment of the present invention there is provided a method of perforating a subterranean formation penetrated by a bore hole having a multiplicity of strata, including a hydrocarbon bearing target strata, with the multiplicity of strata running in a non-horizontal dip. The method generally includes positioning a perforation gun in the well bore adjacent to the hydrocarbon bearing target strata. The method further includes orienting the perforating gun so that it will perforate the hydrocarbon bearing target strata in a direction perpendicular to the dip of the strata. Finally, the method includes perforating the target strata.

According to another embodiment of the present invention there is provided a method of hydraulically fracturing such a subterranean formation as described above. In this particular embodiment, the method includes perforating the target strata in a direction perpendicular to the first direction, and then hydraulically fracturing the formation by pumping a fluid under pressure into the so formed perforations.

These and another embodiments of the present invention will be apparent to those of skill in the art upon review of this specification, its claims, and drawings.

DETAILED DESCRIPTION OF THE INVENTION

The apparatus and method of the present invention will now be described by reference to FIGS. 1–3.

Figure 1:
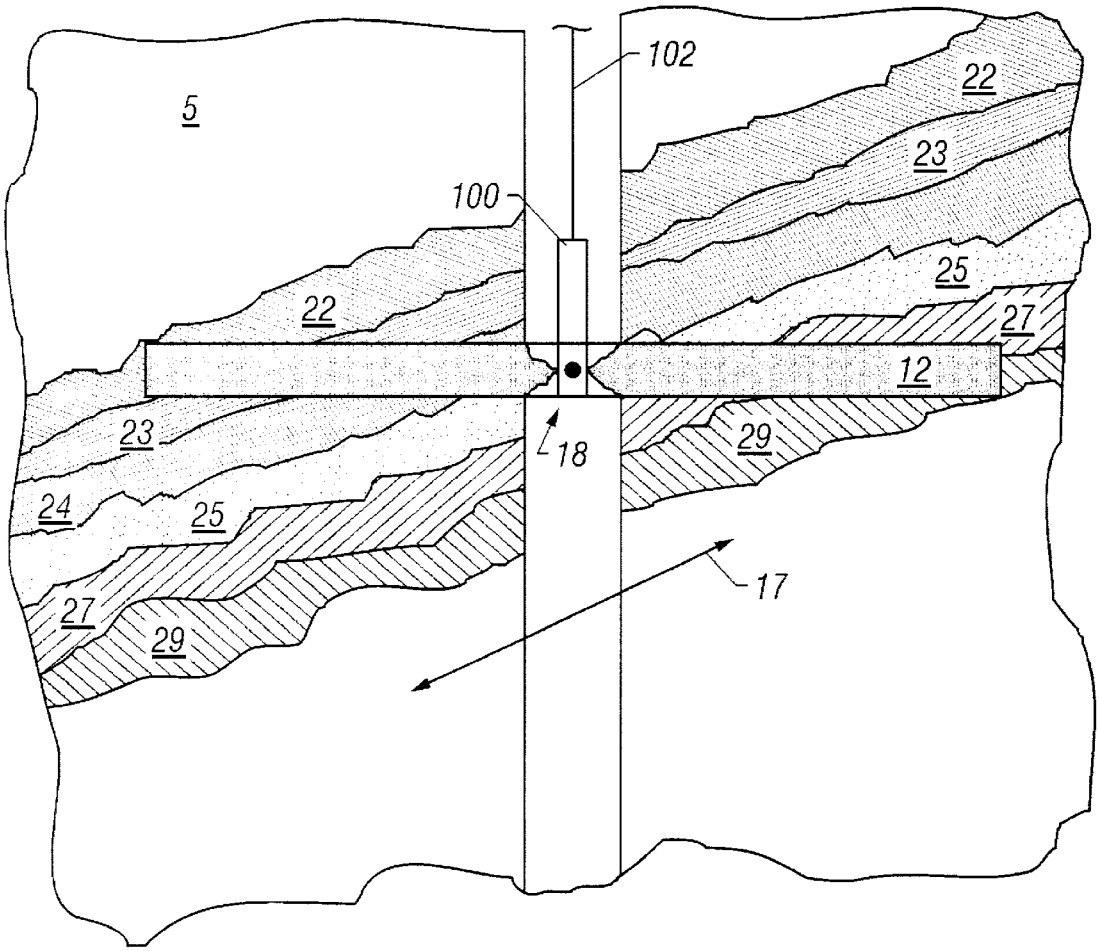
FIG. 1 is an illustration of subterranean 5 having a multiplicity of strata 22–29 generally having a dip indicated by line 17, and wherein reservoir 5 is penetrated by bore hole 6 in which is positioned a perforating tool 100, with perforations to be made into plane of perforation 12 as shown.

Referring first to FIG. 1 there is shown reservoir 5 including a multiplicity of non-hydrocarbon bearing subterranean strata 22, 23, 24, 27, and 29 and hydrocarbon bearing strata 25. As a group, these subterranean strata are generally oriented along a non-horizontal dip shown generally as arrow 17 in FIG. 1. Reservoir 5 is penetrated by bore hole 6 in which is positioned a perforation tool 100 suspended from cable 102.

Plane of perforation 12 extends horizontally and radially away from perforation tool 100 into reservoir 5. As was discussed above, the prior art perforation guns and methods generally perforate into the reservoir in multiple directions away from the bore hole. The problem with such prior art methods is clearly illustrated in FIG. 1 in which it is seen that a horizontally oriented perforation in the direction of dip may cut across two or more of the subterranean strata. For example, as shown in FIG. 1, the plane of perforation starts out in strata 25 on both sides of bore hole 6, but on the left side cuts through subterranean strata 24 and 23 ultimately ending up in strata 22, and on the right side cuts through subterranean strata 27 ultimately ending up in subterranean strata 29. As subterranean strata 25 is the only hydrocarbon bearing strata, and subterranean strata 22, 23, 24, 27 and 29 are non-hydrocarbon bearing strata one or more of which might even yield water, such a perforation is indeed undesirable.

Figure 2:
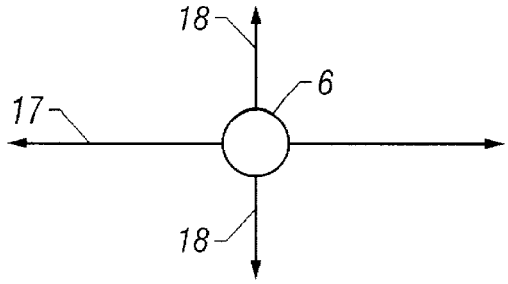
FIG. 2 is a top view of bore hole 6 showing dip of reservoir 17, and positioned 90 degrees therefrom direction of perforation 18 of the present invention.

Referring additionally to FIG. 2, there is shown a top view of bore hole 6 of FIG. 1 with the up-dip-down-dip direction of the reservoir 6 shown as arrow 17, and the desired direction of perforation for the apparatus and method of the present invention shown as arrows 18. In relating the orientation of FIGS. 1 and 2, dip of reservoir 17 in FIG. 2 runs left to right in FIG. 1 and in plane of orientation 12, and the desired direction of perforation 18 in FIG. 2 would run into and out of the page for FIG. 1 in plane of perforation 12.

Direction of perforation 18 is generally oriented perpendicular to dip of reservoir 17. It should be understood that direction of perforation 18 may deviate somewhat from perpendicular to dip of reservoir 17, but that such deviation is risking that the perforation will penetrate non-hydrocarbon strata. It is generally believed that such deviation should not vary more that ±45 degrees from perpendicular, preferably not more than ±30 degrees, and more preferably not more than ±15 degrees, and even more preferably not more than ±5 degrees.

Referring again to FIG. 1, it can be seen that direction of perforation into and out of the page represented by dot 18 will tend to stay in subterranean strata 25 and will not cut into adjacent strata.

Figure 3:
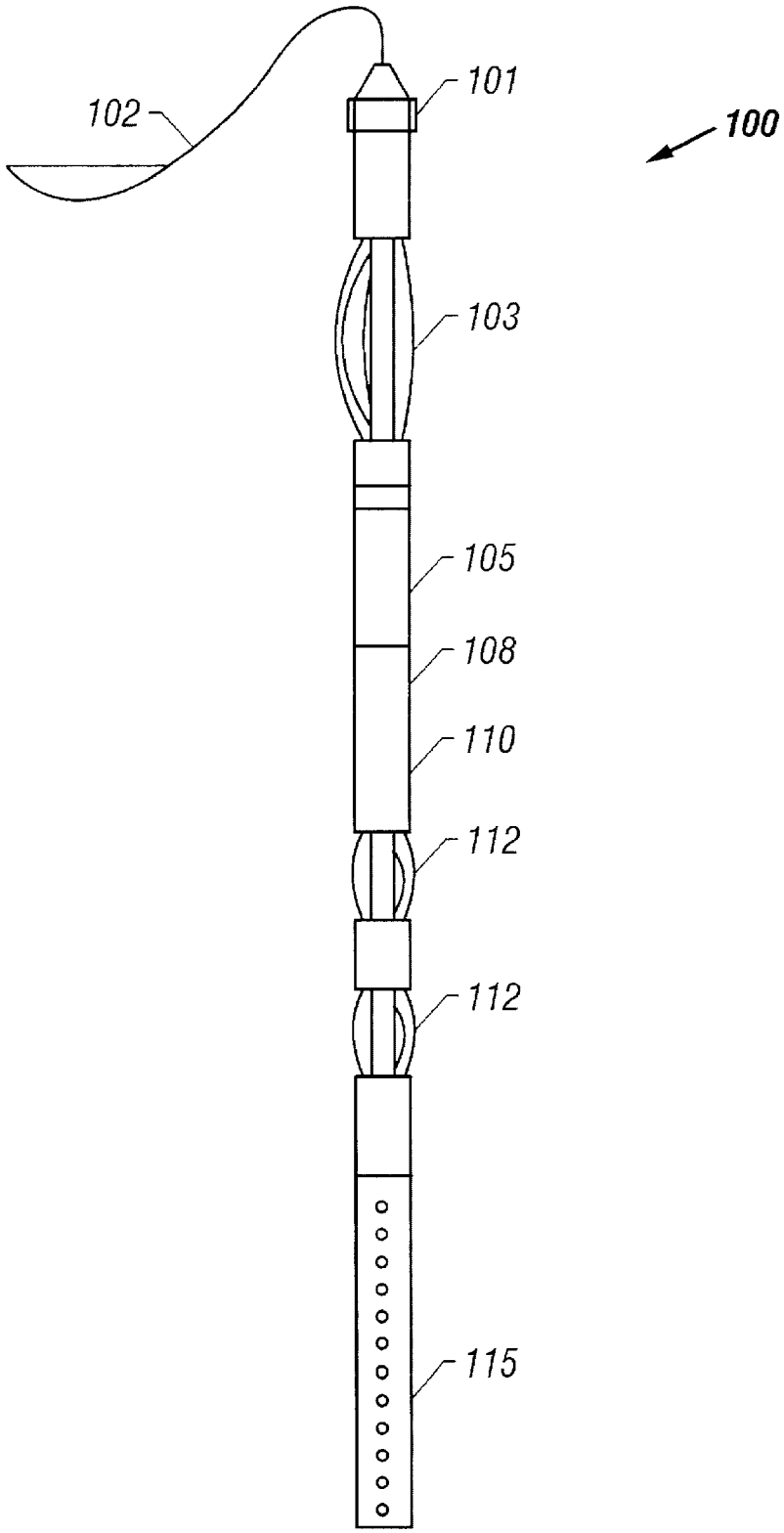
FIG. 3 is an illustration of perforating tool 100 of the present invention showing cable head 101, upper centralizer 103, cable 102, central centralizer 105, operating motor 108, gyro/compass 110, rotating centralizers 112, and perforating gun 115.

Referring additionally to FIG. 3 there is shown perforation gun 100 of the present invention having cable 102, cable head 101, upper centralizer 103, central centralizer 105, orienting motor 108, gyro/compass 110, rotating centralizers 112, and perforation guns 115. In the practice of the present invention, orienting motor 108 and gyro/compass 110 are used to orient perforation guns 115 in the suitable direction of perforation 18.

In the practice of the present invention well bore 6 can be completed in one or more of several ways. For example, or a major portion of the well bore 6 may be open hole, or may have a cemented or uncemented perforated liner, or may have external casing packers on a perforated or slide liner, or be an uncemented slided liner.

In the practice of the present invention, once perforating gun 100 is positioned in well bore 6 at the target depth and oriented to provide perforations in the direction of perforation 18, the perforation operation and subsequent hydraulic fracturing operation are carried out as is well known in the art.

While the illustrative embodiments of the invention have been described with particularity, it will be understood that various other modifications will be apparent to and can be readily made by those skilled in the art without departing from the spirit and scope of the invention. Accordingly, it is not intended that the scope of the claims appended hereto be limited to the examples and descriptions set forth herein but rather that the claims be construed as encompassing all the features of patentable novelty which reside in the present invention, including all features which would be treated as equivalents thereof by those skilled in the art to which this invention pertains.

I claim:

1. A method of perforating a subterranean formation penetrated by a bore hole having a multiplicity of strata including a target strata, with the strata oriented with a non-horizontal dip of the strata running in a first direction, the method comprising:

(a) positioning a perforation gun in the well bore adjacent to target strata;

(b) orienting the perforating gun so that it will perforate the target strata in a direction in the range of about ±45 degrees from perpendicular to the first direction; and, (c) perforating the target strata.

2. The method of claim 1 wherein in step (b) the perforating gun is oriented so that it will perforate the target strata in a direction in the range of about ±30 degrees from perpendicular to the first direction.

3. The method of claim 1 wherein in step (b) the perforating gun is oriented so that it will perforate the target strata in a direction in the range of about ±15 degrees from perpendicular to the first direction.

4. The method of claim 1 wherein in step (b) the perforating gun is oriented so that it will perforate the target strata in a direction in the range of about ±5 degrees from perpendicular to the first direction.

5. The method of claim 1 wherein in step (b) the perforating gun is oriented so that it will perforate the target strata in a direction perpendicular to the first direction.

6. A method of hydraulically fracturing a subterranean formation penetrated by a bore hole having a multiplicity of strata, including a target strata, with the strata oriented with a non-horizontal dip of the strata running in a first direction, the method comprising:

(a) perforating the target strata in a direction in the range of about ±45 degrees perpendicular to the first direction; and (b) pumping a fluid under pressure into the perforations.

7. The method of claim 6 wherein in step (a) the perforating gun is oriented so that it will perforate the target strata in a direction in the range of about ±30 degrees from perpendicular to the first direction.

8. The method of claim 6 wherein in step (a) the perforating gun is oriented so that it will perforate the target strata in a direction in the range of about ±15 degrees from perpendicular to the first direction.

9. The method of claim 6 wherein in step (a) the perforating gun is oriented so that it will perforate the target strata in a direction in the range of about ±5 degrees from perpendicular to the first direction.

10. The method of claim 6 wherein in step (a) the perforating gun is oriented so that it will perforate the target strata in a direction perpendicular to the first direction.

* * * * *